US012497775B2

(12) United States Patent
Freidberg

(10) Patent No.: US 12,497,775 B2
(45) Date of Patent: Dec. 16, 2025

(54) SELF-SEALING INSULATED PANEL

(71) Applicant: LOUISIANA-PACIFIC CORPORATION, Nashville, TN (US)

(72) Inventor: Neil Freidberg, Lebanon, TN (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 345 days.

(21) Appl. No.: 18/238,693

(22) Filed: Aug. 28, 2023

(65) Prior Publication Data

US 2024/0068232 A1 Feb. 29, 2024

Related U.S. Application Data

(60) Provisional application No. 63/401,201, filed on Aug. 26, 2022.

(51) Int. Cl.

| | |
|---|---|
| ***E04C 2/296*** | (2006.01) |
| ***E04C 2/00*** | (2006.01) |
| ***E04C 2/04*** | (2006.01) |

(52) U.S. Cl.

CPC ..... *E04C 2/296* (2013.01); *E04C 2/049* (2013.01); *E04C 2002/004* (2013.01)

(58) Field of Classification Search

CPC .... E04C 2/296; E04C 2/049; E04C 2002/004; E04C 2/246; E04F 13/0889; E04F 13/0878; E04F 13/10; E04F 13/18; E04F 2201/0523; E04F 2203/06

See application file for complete search history.

(56) References Cited

U.S. PATENT DOCUMENTS

| | | | | |
|---|---|---|---|---|
| 3,164,511 A | | 1/1965 | Elmendorf | |
| 3,412,518 A | * | 11/1968 | Waite | E04B 1/80 52/249 |
| 4,364,984 A | | 12/1982 | Wentworth | |
| 4,572,865 A | | 2/1986 | Gluck et al. | |
| 5,349,796 A | | 9/1994 | Meyerson | |
| 5,425,976 A | | 6/1995 | Clarke et al. | |

(Continued)

FOREIGN PATENT DOCUMENTS

WO WO 02081841 A1 10/2022

OTHER PUBLICATIONS

International Search Report and Written Opinion, PCT/US23/31259, Lousiana-Pacific Corp. (international filing date Aug. 28, 2023).

(Continued)

*Primary Examiner* — Rodney Mintz

(74) *Attorney, Agent, or Firm* — Wayne Edward Ramage; Baker Donelson

(57) ABSTRACT

A self-sealing insulated panel, comprising an insulating foam board adhered or attached to a manufactured wood structural panel (e.g., oriented-strand board (OSB), plywood, or the like). The corresponding opposing edges of the insulating foam board comprise the two corresponding elements (male and female) of a modified ship-lap joint. The self-sealing insulated panel provides a component of an air-resistant and weather/water-resistant barrier in addition to insulation for a wall structure when installed when the foam board is placed facing outward towards the exterior face of the wall. The foam board provides insulation value as a foam insulation layer if placed facing inwards towards the interior of the wall.

13 Claims, 8 Drawing Sheets

(56) References Cited

U.S. PATENT DOCUMENTS

| | | | | |
|---|---|---|---|---|
| 5,470,631 | A | 11/1995 | Lindquist et al. | |
| 5,525,394 | A | 6/1996 | Clarke et al. | |
| 5,695,870 | A | 12/1997 | Kelch et al. | |
| 5,718,786 | A | 2/1998 | Lindquist et al. | |
| 6,461,743 | B1 | 10/2002 | Tanzer et al. | |
| 7,713,615 | B2 * | 5/2010 | Black | B32B 13/12 52/781.5 |
| 7,954,292 | B2 * | 6/2011 | Holt | E04F 13/0878 52/522 |
| 8,215,083 | B2 | 7/2012 | Toas et al. | |
| 8,409,380 | B2 * | 4/2013 | Black | B32B 13/06 156/367 |
| 8,966,843 | B2 | 3/2015 | Paul et al. | |
| 9,010,044 | B2 | 4/2015 | Bennett et al. | |
| 10,316,515 | B2 | 6/2019 | Budinscak, Jr. et al. | |
| 10,570,616 | B2 | 2/2020 | Sealock et al. | |
| 10,920,420 | B2 * | 2/2021 | Karnicki | E04C 2/16 |
| 12,345,041 | B1 * | 7/2025 | St. Germain | E04F 13/0889 |
| 12,359,423 | B2 * | 7/2025 | Yelle | B27N 7/00 |
| 2003/0046891 | A1 * | 3/2003 | Colada | B32B 13/12 52/541 |
| 2003/0054123 | A1 * | 3/2003 | Black | B32B 13/12 428/34.4 |
| 2003/0056458 | A1 * | 3/2003 | Black | B32B 7/12 52/541 |
| 2007/0261353 | A1 | 11/2007 | Cullen | |
| 2009/0249721 | A1 * | 10/2009 | Cullen | E04F 13/04 52/309.3 |
| 2009/0283201 | A1 * | 11/2009 | Black | B28B 1/002 156/71 |
| 2010/0064611 | A1 | 3/2010 | Holt | |
| 2011/0258944 | A1 | 10/2011 | Radoane | |
| 2012/0247042 | A1 | 10/2012 | Clancy et al. | |
| 2013/0180198 | A1 * | 7/2013 | Olson | E04F 13/18 52/591.4 |
| 2018/0179754 | A1 * | 6/2018 | Karnicki | B32B 21/042 |
| 2018/0298609 | A1 | 10/2018 | Banerjee et al. | |
| 2021/0348388 | A1 | 11/2021 | Budinscak, Jr. et al. | |
| 2021/0396010 | A1 | 12/2021 | Rudisill et al. | |
| 2022/0090374 | A1 * | 3/2022 | Yelle | E04C 2/16 |
| 2023/0047169 | A1 * | 2/2023 | Merrick | E04F 13/0871 |
| 2024/0059052 | A1 | 2/2024 | Fu et al. | |
| 2024/0059856 | A1 | 2/2024 | Fu et al. | |
| 2024/0060303 | A1 | 2/2024 | Fu et al. | |
| 2024/0068233 | A1 * | 2/2024 | Freidberg | B32B 3/06 |

OTHER PUBLICATIONS

International Search Report and Written Opinion, PCT/US23/31267, Lousiana-Pacific Corp. (international filing date Aug. 28, 2023).

* cited by examiner

SELF-SEALING INSULATED PANEL

This application claims benefit of and priority to U.S. Provisional Application No. 63/401,201, filed Aug. 26, 2022, which is incorporated herein in its entirety by specific reference for all purposes.

FIELD OF INVENTION

This invention relates to a self-sealing wood composite insulated panel, such as oriented strand board (OSB), particleboard, medium density fiberboard (MDF), or other cellulose-based structural panels with an insulated foam board attached thereto.

BACKGROUND OF THE INVENTION

In general, wood-based composites include, but are not limited to, oriented strand board (OSB), wafer board, flake board, particleboard, and fiberboard (e.g., medium density fiberboard, or MDF). These wood-based composites are typically formed from a wood element (e.g., flake, strand, particle, wafer) combined with a thermosetting adhesive to bind the wood substrate together. In some processes, other additives are added to impart additional properties to the wood composites. Additives may include fire retardants, fungicides, mildew-cides, insecticides, and water repellents. A significant advantage of strand and particle-based wood composites is that they have many of the properties of plywood and dimension lumber, but can be made from a variety of lower grade wood species, smaller trees and waste from other wood product processing. In addition, they can be formed into panels in lengths and widths independent of the size of the harvested timber.

One class of wood-based composites products comprise multilayer, oriented wood strand panel products. These oriented-strand, multilayer composite wood panel products are composed of several layers of thin wood strands, which are wood particles having a length which is several times greater than their width. These strands are created from debarked round logs by placing the edge of a cutting knife parallel to a length of the log and then slicing thin strands from the log. The result is a strand in which the fiber elements are substantially parallel to the strand length. These strands can then be oriented on a mat-forming line with the strands of the outer face layers predominantly oriented in a parallel-to-machine direction, and strands in the core layer generally oriented perpendicular to the face layers (i.e., "cross-machine") direction.

In one known commercial process, these mat layers are bonded together using natural or synthetic adhesive resins under heat and pressure to make the finished product. Oriented, multilayer wood strand panels of the above-described type can be produced with mechanical and physical properties comparable to those of commercial softwood plywood and are used interchangeably, such as for wall and roof sheathing. In certain types of construction, these wood-based panels (and other construction materials) may be required by building codes to meet certain durability requirements, such as fire, wind and water resistance.

Oriented, multilayer wood strand panels and similar products of the above-described type, and examples of processes for pressing and production thereof, are described in detail in U.S. Pat. No. 3,164,511 (Elmendorf, issued Jan. 5, 1965), U.S. Pat. No. 4,364,984 (Wentworth, issued Dec. 21, 1982), U.S. Pat. No. 5,425,976 (Clarke, et al., issued Jun. 20, 1995), U.S. Pat. No. 5,470,631 (Lindquist, et al., issued Nov. 28, 1995), U.S. Pat. No. 5,525,394 (Clarke, et al., issued Jun. 11, 1996), U.S. Pat. No. 5,718,786 (Lindquist, et al., issued Feb. 17, 1998), and U.S. Pat. No. 6,461,743 (Tanzer, et al., issued Oct. 8, 2002), all of which are incorporated herein in their entireties by specific reference for all purposes.

A structural insulated sheathing panel is disclosed in Rudisill et al., U.S. Pat. Pub. 2021/0396010 (Dec. 23, 2021), which is incorporated herein in its entirety by specific reference for all purposes. This discloses an insulating layer, including foam polymer insulation, secured to the inward facing surface of a structural panel, with the opposite, exterior facing surface comprises a separate weather-resistant barrier (WRB) layer, in particular a resin-impregnated paper overlay. The gaps between the structural panels when installed on a structure are covered over with a seam sealant such as water-resistant seam sealant tape. However, the panels of Rudisill do not disclose a foam layer having profiled edges to form a self-sealing joint.

SUMMARY OF THE INVENTION

In various exemplary embodiments, the present invention comprises a self-sealing insulated panel, comprising an insulating foam board adhered or attached to a manufactured wood structural panel (e.g., oriented-strand board (OSB), plywood, or the like). The self-sealing insulated panel provides a component of an air-resistant and weather/water-resistant barrier in addition to insulation for a wall structure when installed when the foam board is placed facing outward towards the exterior face of the wall. The foam board provides insulation value as a foam insulation layer if placed facing inwards towards the interior of the wall (i.e., so that the foam is disposed between the manufactured wood structural panel and the studs in the wall framework).

The corresponding opposing edges of the insulating foam board comprise the two corresponding elements (male and female) of a modified ship-lap joint. The insulating foam board may have male elements on two adjacent edges, and female elements on the other two edges, so that adjacent boards can be positioned to form the complete joint. The self-sealing insulated panels may be installed in a correct shingling pattern vertically or horizontally for drainage. The foam board allows another foam board to seat edge-to-edge on the foam board and form the joint. When interlocked and nailed (or otherwise fastened to the wall or other structural frame), the foam board joint provides a drip edge preventing water from flowing into the interior of the wall. The sloped angle below the drip edge, and the spacing between the joint elements, allows for a passive flow of water out of the joint and prevents a capillary effect drawing water into the joint.

In several embodiment, the joint elements are sized to provide for a ⅛" gap between the underlying structural panels. The joint elements may be sized to provide for different gap spacing, as desired.

BRIEF DESCRIPTION OF INVENTION

Figure 3:
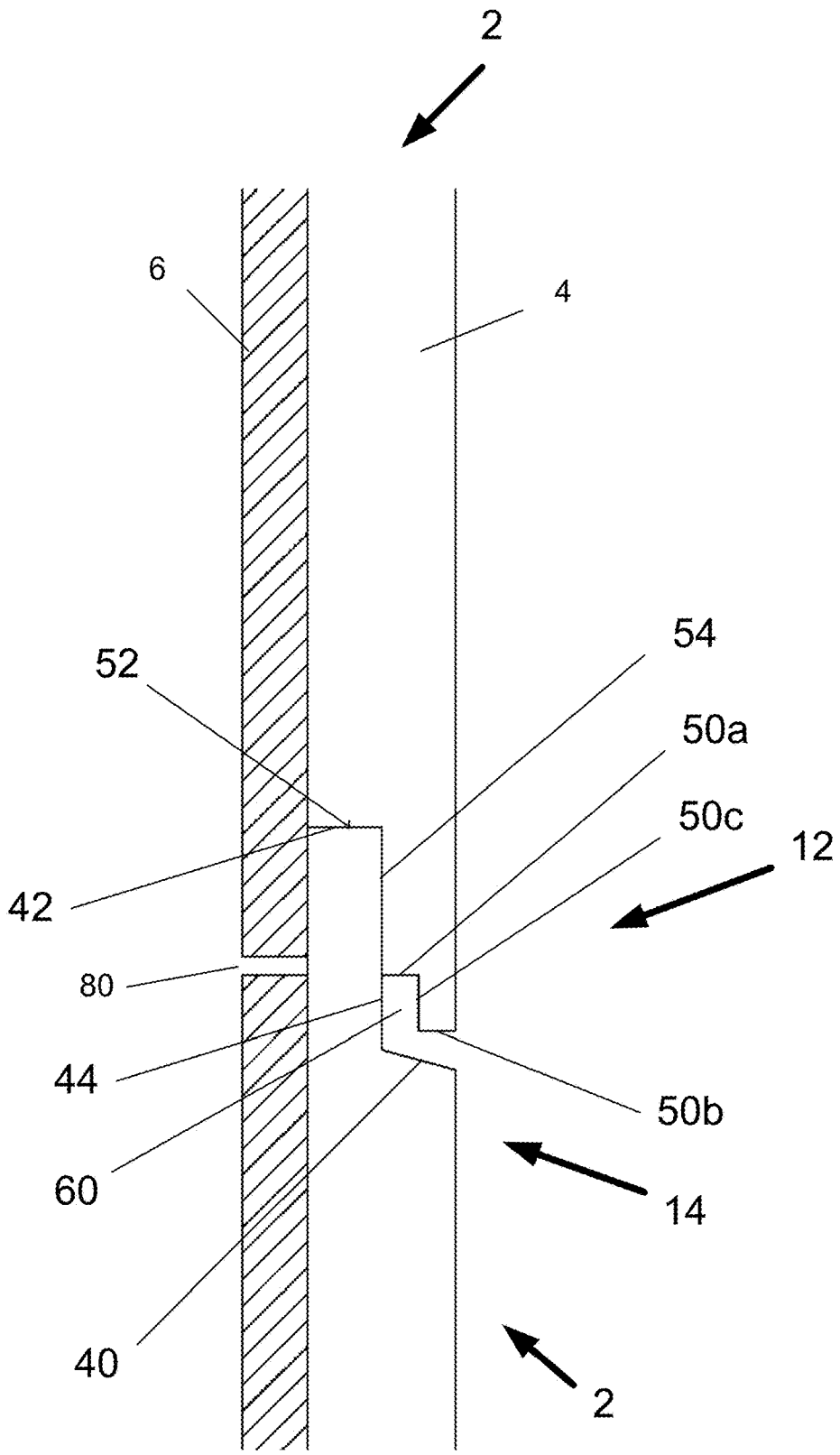
FIG. 3 shows another cross-section of the joint formed by FIG. 1.
Figure 4:
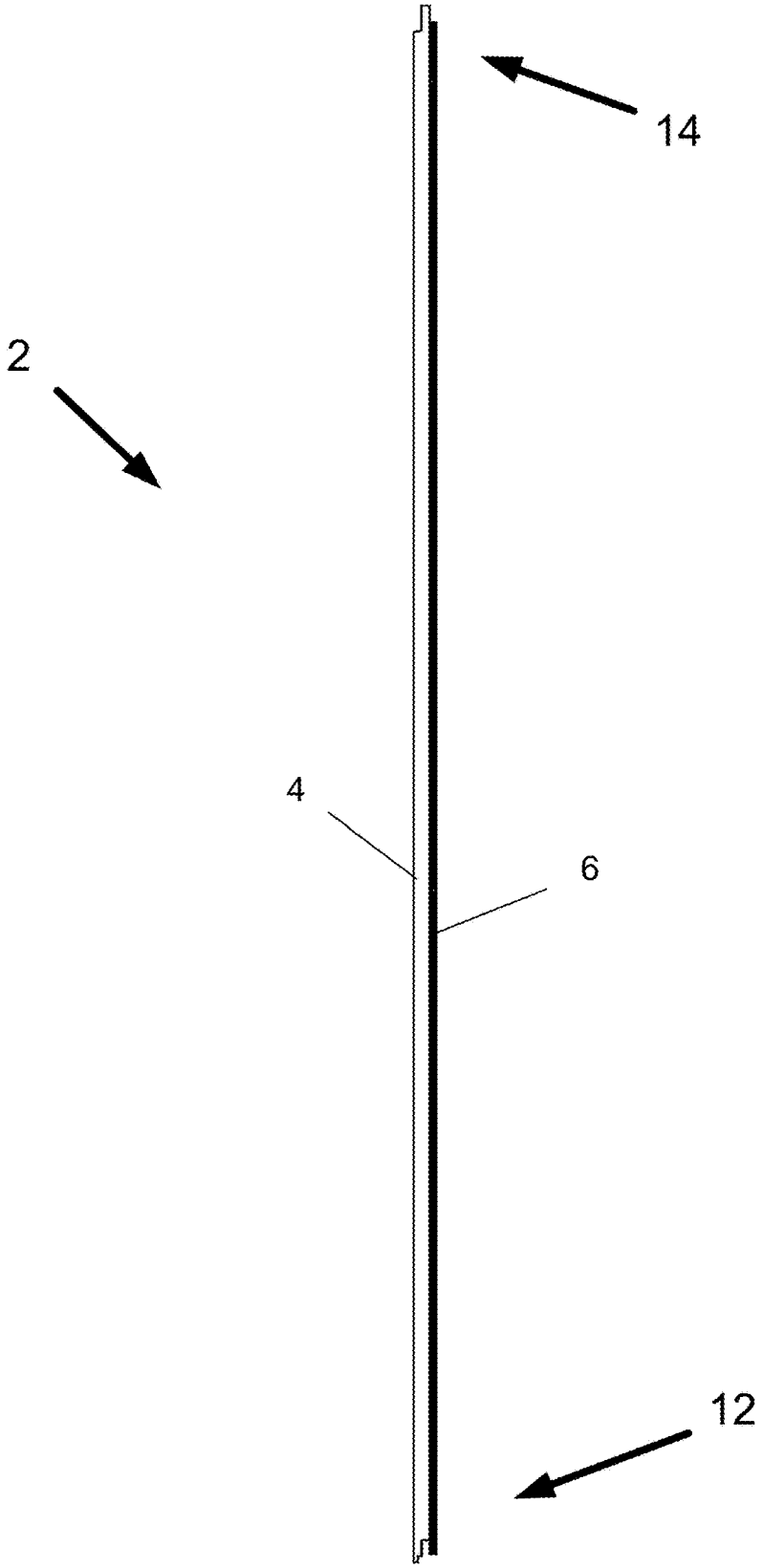
FIG. 4 shows a side view of a self-sealing insulated panel product.

In various exemplary embodiments, the present invention comprises a self-sealing insulated panel 2, comprising an insulating foam board (or foam insulation board) 4 adhered or attached to a manufactured wood structural panel (e.g., oriented-strand board (OSB), plywood, or the like) 6. The self-sealing insulated panel 2 provides a component of an air-resistant and weather/water-resistant barrier in addition to insulation for a wall structure when installed when the foam board 4 is placed facing outward towards the exterior face of the wall, as seen in FIG. 3. The foam board provides insulation value as a foam insulation layer if placed facing inwards towards the interior of the wall (i.e., so that the foam is disposed between the manufactured wood structural panel 6 and the studs in the wall framework), as seen in FIG. 4.

The corresponding opposing edges 12, 14 of the insulating foam board comprise the two corresponding elements (overlap 12 and underlap 14) of a modified ship-lap joint 10. The insulating foam board may have overlap elements 12 on two adjacent edges, and underlap elements 14 on the other two edges, so that adjacent boards can be positioned to form the complete joint 10, as seen in FIG. 2.

Figure 2:
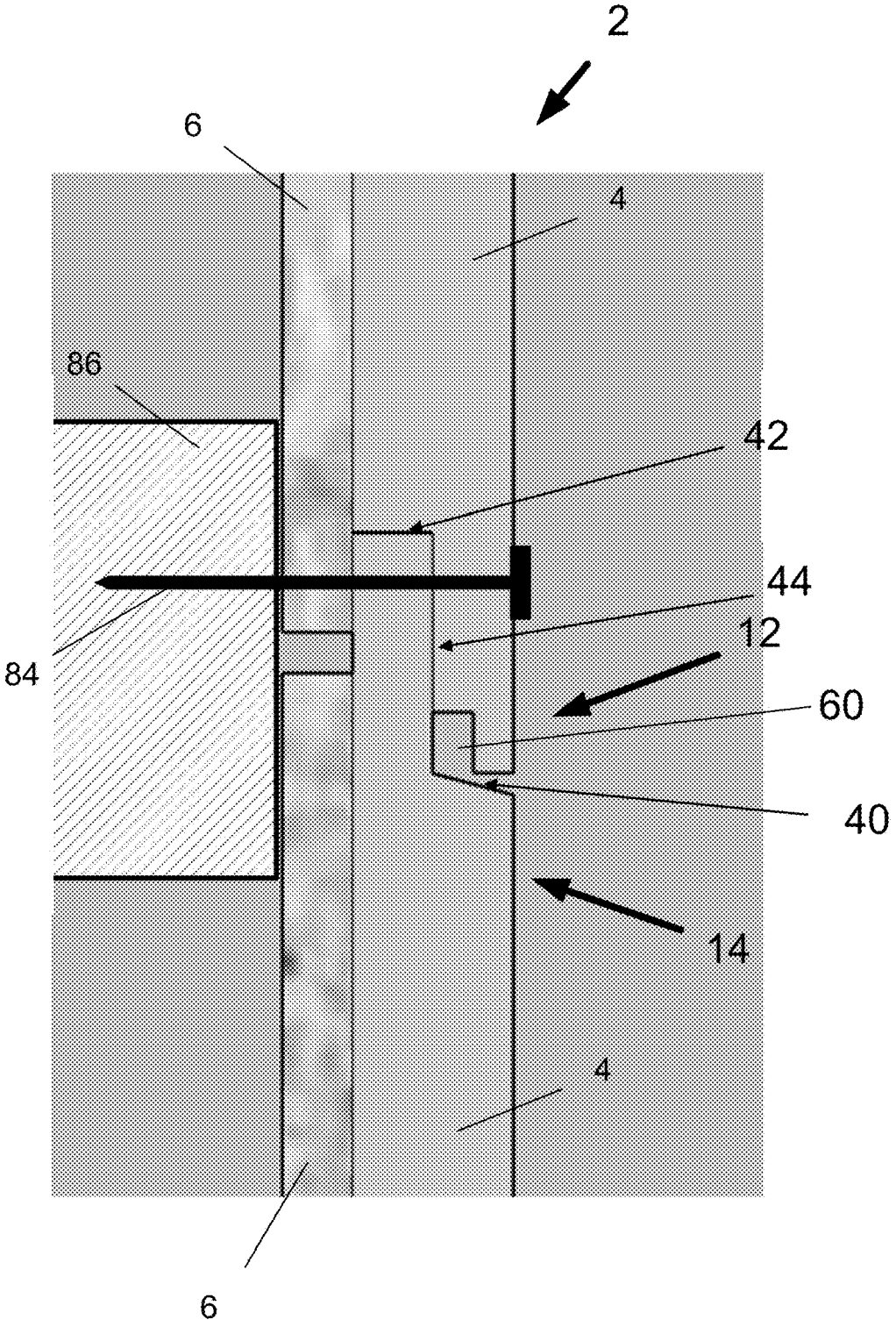
FIG. 2 shows a cross-section of the joint formed by the adjacent joint edges of FIG. 1.

As seen in FIGS. 2 and 3, the underlap element 14 comprises an outward-facing main face 44 generally parallel to the front (or outer) face and back (or inner) face of the panel, an inner edge face 42 generally orthogonal to the underlap main face 44 and extending therefrom to the back face of the panel, and an angled or sloped outer edge face 40 extending at an obtuse angle from the underlap main face 44 to the front face of the panel. Similarly, the overlap element 12 comprises an inward-facing main face 54 generally parallel to the front (or outer) face and back (or inner) face of the panel, an inner edge face 52 generally orthogonal to the overlap main face 54 and extending therefrom to the back face of the panel, and an outer edge face with two portions 50*a, b* generally orthogonal to the overlap main face 54 with a third portion therebetween 50*c* generally parallel to the main face 54, with the outermost outer edge face portion 50*b* extending the from the third portion 50*c* to the front face of the panel. FIG. 4 shows a side view of a panel in accordance with the present invention.

A self-sealing insulated panel 2 may be installed with other similar panels in a correct shingling pattern vertically or horizontally for drainage, as seen in FIGS. 5-8. The foam board profiling allows an adjacent foam board to seat with another foam board, edge-to-edge, and form the joint. When interlocked and nailed or otherwise fastened to the wall or other structural frame, the foam board joint along the horizontal edges, formed with the overlap element 12 on the upper panel and the underlap element 14 on the lower panel, provides a drip edge 30 preventing water from flowing into the joint and then into the interior of the wall. The sloped angle formed by the underlap angled outer edge face 40 below the drip edge 30, and the open spacing 60 between the joint elements when the joint is formed, allows for a passive flow of water out of the joint and prevents a capillary effect drawing water into the joint.

As seen in FIG. 3, when the joint is fully formed, the joint elements are sized to provide a gap 80 between the respective edges of the two underlying manufactured wood structural panels 6. This allows lateral expansion and retraction of the manufactured wood structural panels 6 without buckling or warping. In the embodiment shown, the gap is ⅛" wide, although the joint elements may be sized to provide for different gap spacing, as desired.

When the joint is fully formed, the respective inner edge faces 42, 52 of the joint elements in the foam boards 4 are fully seated and in contact with each other, and the entirety of the overlap main face 54 is in contact with the portion of the underlap main face 44 adjacent the respective inner edge face. A portion of the underlap main face 44 is not in contact with any portion of the overlap element, and thus forms and is open to the space 60. The length of the open portion of the underlap main face is longer than or at least as long as the length of the third portion 50*c* of the overlap outer edge. No portion of the respective outer edge faces 40, 50*a-c* is in contact with any portion of the other outer edge face.

In several embodiments, a nail or other fastening means 84 may be used to securely fasten a self-sealing insulated panel to underlying framing, wall, or support structure 86, thereby contributing to forming an air-barrier and weather-resistant or water-resistant barrier. In some embodiments, a single nail or fastening means may be placed to penetrate both foam boards in the fully seated portion of the formed joint, thereby securing the respective self-sealing insulated panels together.

Figure 1:
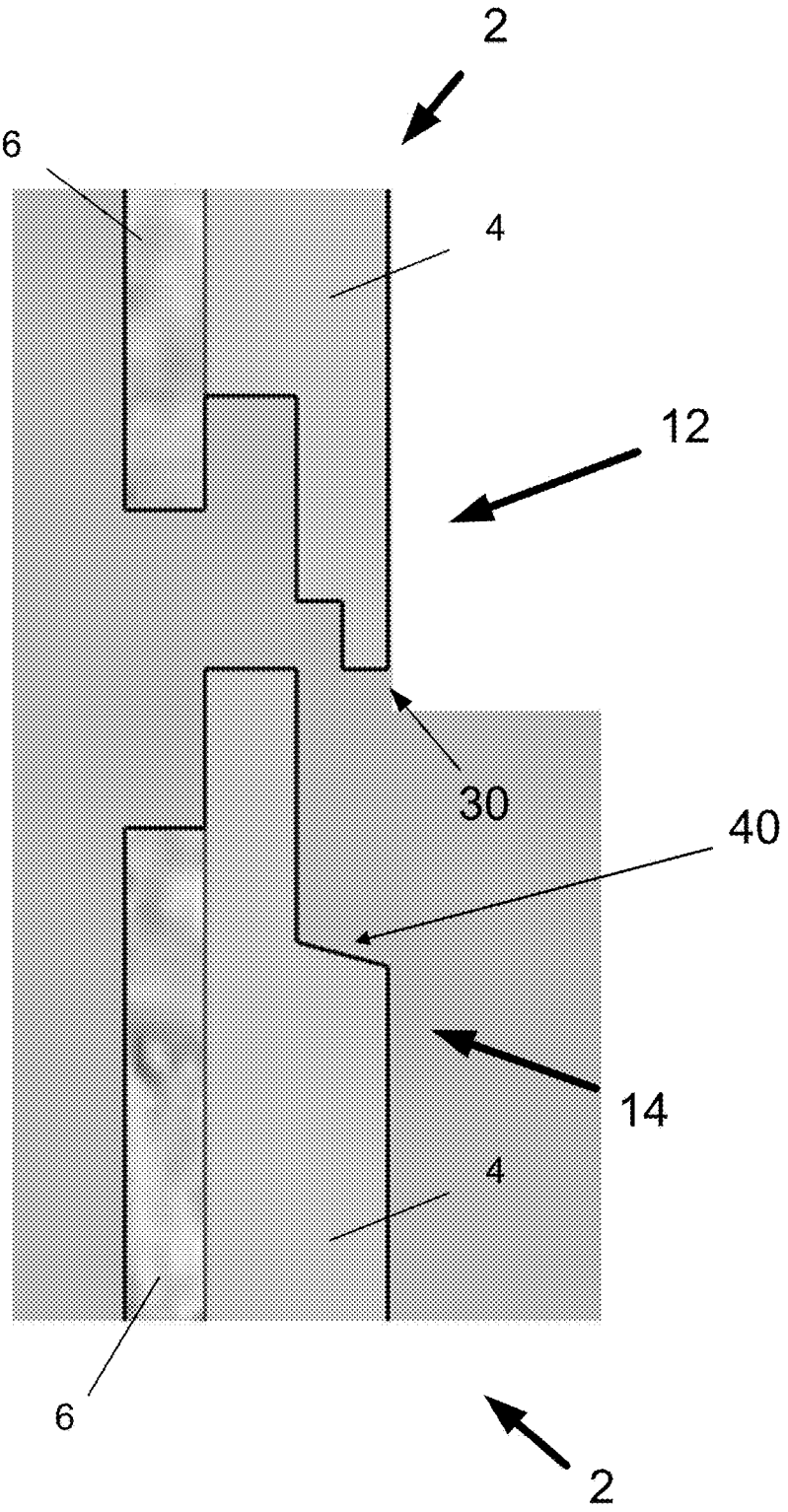
FIG. 1 shows a cross section of two adjacent joint edges of an insulated panel product in accordance with the present invention.
Figure 5:
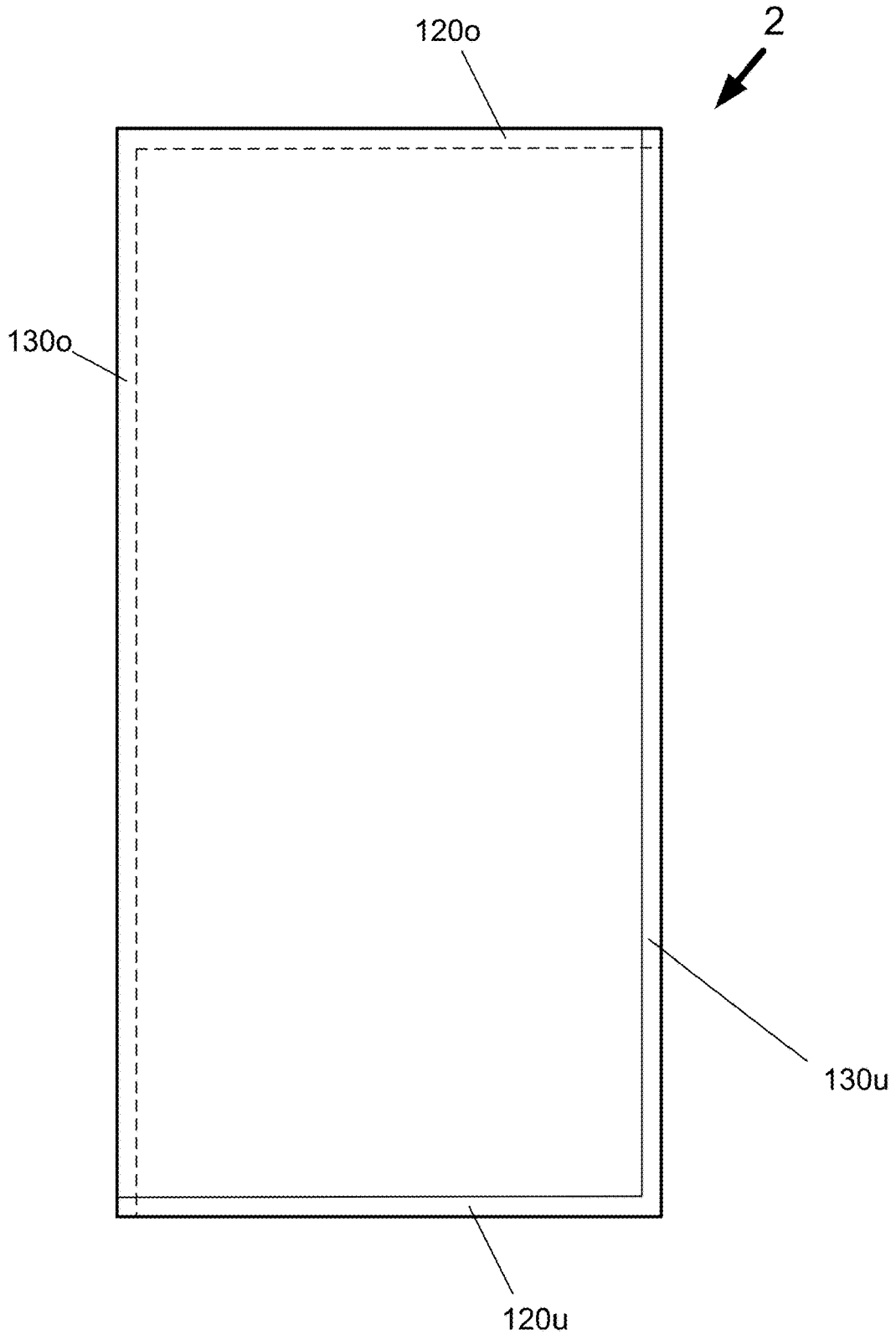
FIG. 5 shows a facial view of the foam board side of the panel product of FIG. 4.

FIG. 5 shows a front view of an example of the foam board face side of a self-sealing insulated panel 2 for a typical 4' wide by 8' long panel. One edge 120*o* along the narrow panel dimension (e.g., the 4' panel width) and an adjacent edge 30*o* along the long panel dimension (e.g., the 8' or longer panel length) are configured as an overlap portion of a modified shiplap joint (with FIG. 1 showing the foam board face view of the panel, the overlap portion is shown in broken lines), while the opposite edges 120*u*, 130*u* are configured as corresponding underlap portion (shown in solid lines). Other panel length and width dimensions may be provided, as desired. In some embodiments, all panel edges are equal in length.

Figure 6:
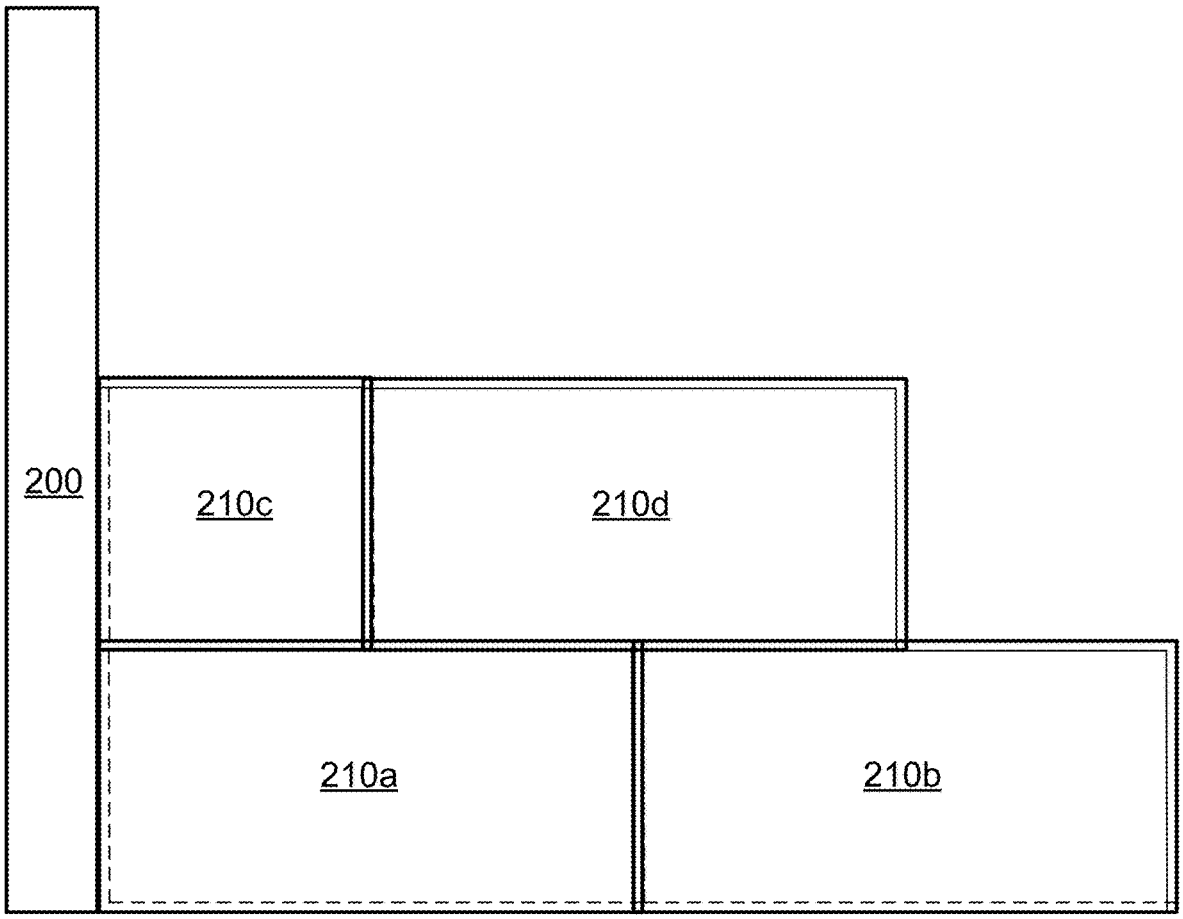
FIGS. 6 and 7 show views of a plurality of the panel product of FIGS. 4 and 5 being installed on a wall structure with vertical and horizontal shingling patterns.

During installation on a wall (or roof), the first panel 210*a* installed may be on the side of the wall which allows the overlap panel edge (or underlap panel edge, in some installment configurations) to be nearest and flush to the wall framing 200 so that the overlap joint of the next adjacent panel being installed 210*b* will cover the underlap of the first panel installed (or vice-versa). The configuration is such that the panels may be installed horizontally, with the long (8' or longer) panel dimension installed perpendicular to the vertical wall framing 200 (as seen in FIG. 6). Subsequent panels, which may be shorter in length (e.g., 4' long and 4' wide) 210*c*, or longer (e.g., 8' long and 4' wide) 210*d*, may then be added in appropriate order. As shown, the panels in successive rows may be placed so that panel corners where an overlap edge and an underlap edge meet in a row are staggered.

Figure 7:
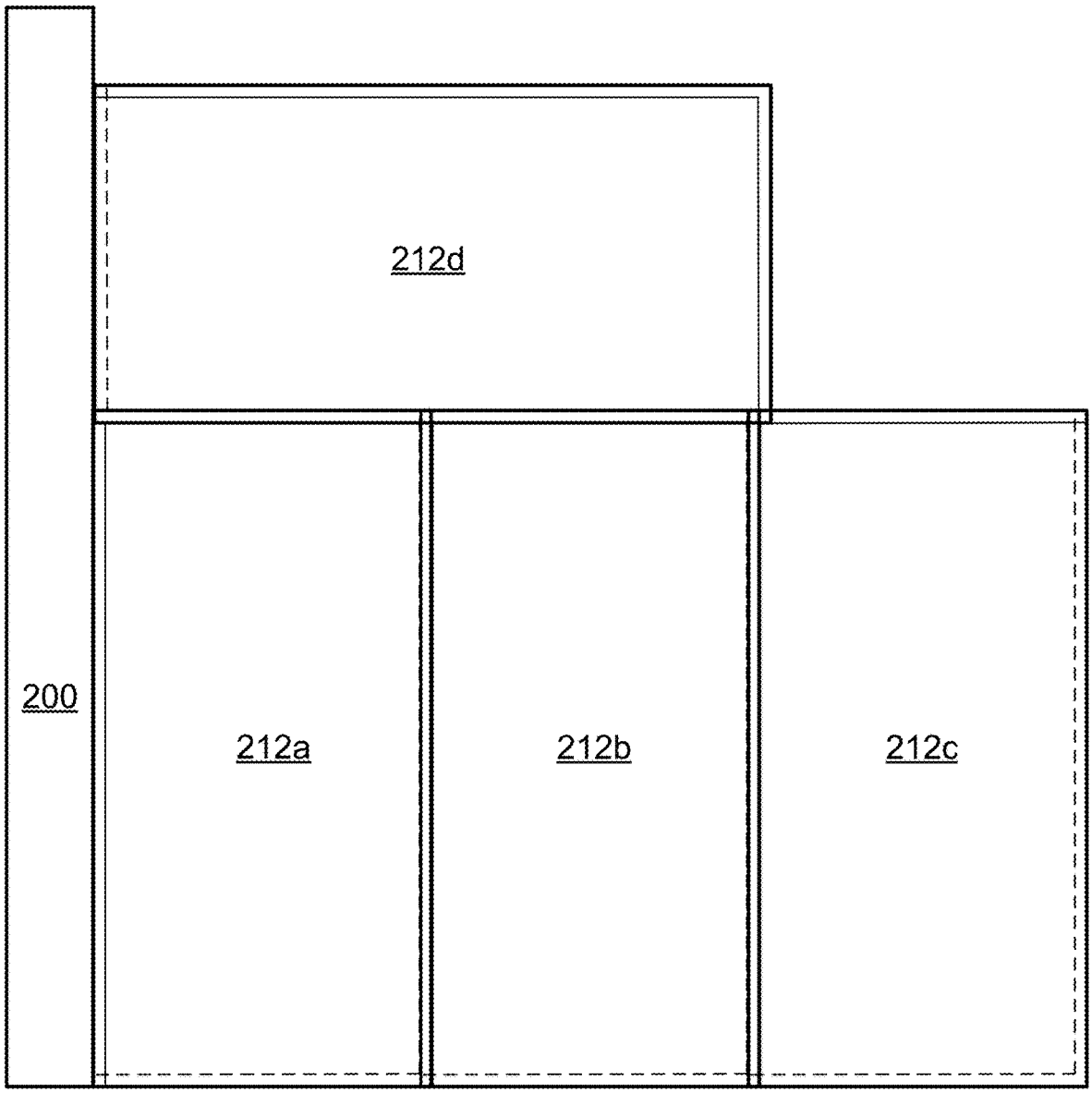

Alternatively, the same panels may also be installed vertically 212*a-c*, with the long (e.g., 8' or longer) panel dimension installed parallel to the vertical wall framing 200 (see FIG. 7). If a second horizontal row of panels are required, the top edge of the first row would be the underlap side of the shiplap joint (or vice versa). The second row of panels would then have the overlap joint (or underlap, depending on the configuration of the first row) on the bottom which then overlaps onto the underlap of the first row of panels installed. In some embodiments, the first row (212*a-c*) is vertically oriented and the second row (212*d*) is horizontally oriented (or vice-versa). This interlocking shiplap configuration repeats itself until the full wall area is covered.

Figure 8:
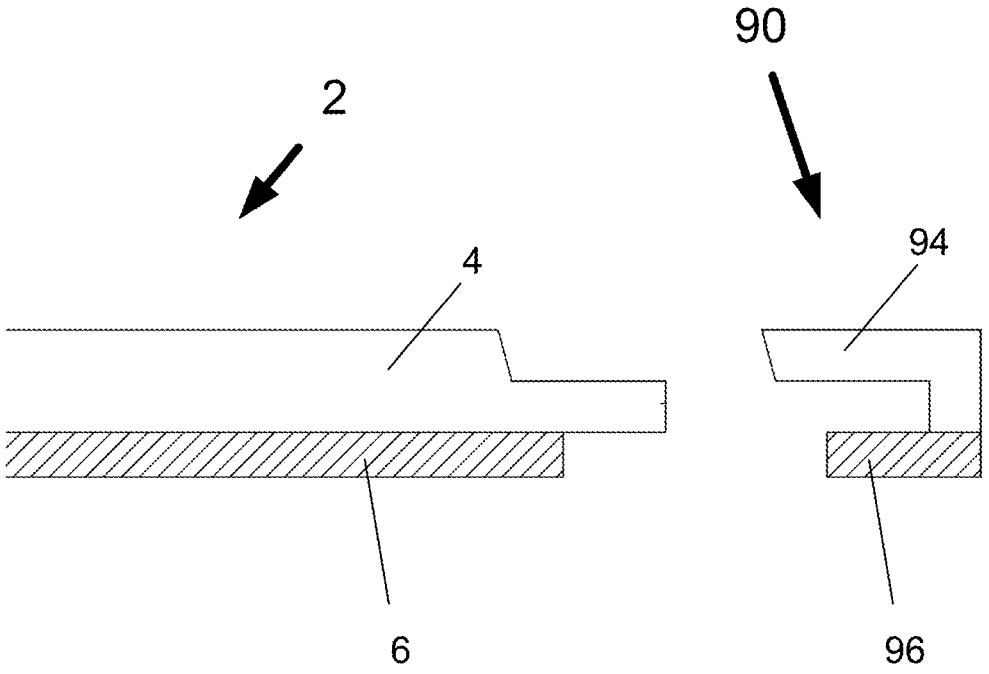
FIG. 8 shows an edge protector for an underlap element edge.

The foam board is generally attached to underlying structural panel (e.g., OSB) by glue, lamination, or the like in a factory setting or factory production line. While there is some protection for the foam edges when the self-sealing insulation panels are stacked for shipping, in some embodiments a shipping edge protector 90 may be used to cover and protect one or more of the joint edges on a panel. The shipping edge protectors generally match and engage the corresponding joint edge. FIG. 8 shows an example of a shipping edge protector for the underlap edge. In one embodiment, shipping edge protectors are used on all four edges, although in other embodiments, shipping edge protector may be used only one type of edge profile, such as the underlap edge. The shipping protector can be made partially or entirely of foam, such as the same or similar foam used for the foam board 4. In the embodiment shown, a portion of the protector may be made of stiffer supporting material 96, such as, but not limited to, paperboard, cardboard, or wood. The protector also may be made entirely of the stiffer supporting material.

The foam board may comprise any type of foam or foam board insulation known in the art, including, but not limited to, open cell or closed cell foam, expanded polystyrene (EPS), extruded polystyrene (XPS), and/or polyisocyanurate (polyiso, iso). The foam board may be of any suitable thickness, depending on the design of the structure and desired insulation value. As seen in the figures, thickness of the foam board is generally greater than the thickness of the underlying structural panel, although in alternative embodiments the thicknesses may be the same, or the foam board may be thinner than the underlying structural panel.

While the modified shiplap joint of the present invention has been described in the context of a foam board, a person of skill in the art would recognize that the modified shiplap joint may also be used with other panel materials (such as, but not limited to, wood or manufactured-wood) and in other arrangements.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A modified shiplap joint, comprising:

an underlap element with a back face, a front face, a frontward-facing main face parallel to the underlap back face and underlap front face, an inner edge face extending from the underlap main face to the underlap back face, and an outer edge face extending at an obtuse angle from the main face to the front face; and an overlap element with a back face, a front face, a backward-facing main face parallel to the overlap back face and overlap front face, an inner edge face extending from the overlap main face to the overlap back face, and a three-part outer edge comprising a first portion orthogonal to the overlap main face and adjacent thereto, a second portion orthogonal to the front face of the overlap element and adjacent thereto, and a third portion extending between the first portion and the second portion, and parallel to the overlap main face.

2. The modified shiplap joint of claim 1, wherein, when the joint is fully formed:

the inner edge face of the underlap element is in contact with the inner edge face of the overlap element;

a portion of the underlap main face is in contact with an entirety of the overlap main face, with a remainder of the underlap main face not in contact with any part of the overlap element;

the angled outer face edge of the underlap element is not in contact with any part of the overlap element; and the third portion of the three-part outer edge of the overlap element is not in contact with any part of the underlap element;

wherein a space is formed in the formed joint proximate the angled outer face edge of the underlap element and the three-part outer edge of the overlap element.

3. The modified shiplap joint of claim 2, wherein the underlap element and overlap element comprise expanded polystyrene, extruded polystyrene, or polyisocyanurate foam.

4. The modified shiplap joint of claim 2, wherein the underlap element and overlap element comprise wood or manufactured wood.

5. A self-sealing insulated panel, comprising:

a manufactured-wood structural panel with a front face and a back face;

a foam insulation board with a back face and a front face, the back face of the foam insulation board affixed to the front face of the manufactured-wood structural panel;

wherein opposing edges of the foam insulation board comprise corresponding male and female joint elements of the modified shiplap joint of claim 1, wherein a drip edge along an outermost edge of the overlap element is not in contact with any part of the underlap element when the joint is formed, and the angled outer edge face is not in contact with any part of the overlap element when the joint is formed.

6. The self-sealing insulated panel of claim 5, further wherein a portion of the main face of the underlap element is not in contact with any part of the overlap element when the joint is formed, thereby forming a space therebetween.

7. The self-sealing insulated panel of claim 5, wherein the manufactured-wood structural panel and the foam insulation board are pre-formed into an integrated multilayered configuration.

8. The self-sealing insulated panel of claim 5, wherein the foam insulation board is laminated to the manufactured-wood structural panel.

9. The self-sealing insulated panel of claim 5, wherein the foam insulation board is affixed by adhesive or glue to the manufactured-wood structural panel.

10. The self-sealing insulated panel of claim 5, wherein each underlap element further comprises a respective said underlap inner edge face extending from the underlap main face to the back face of the foam insulation board; and wherein each overlap element further comprises a respective said overlap inner edge face extending the overlap main face to the back face of the foam insulation board.

11. The self-sealing insulated panel of claim 5, wherein the drip edge and angled face, when the joint is formed, are configured to prevent water from penetrating through the joint to the back face of the foam insulation board.

12. The self-sealing insulated panel of claim 5, wherein dimensions of the underlap element and overlap element are configured to provide a gap between respective edges of adjacent manufactured-wood structural panels when the joint is formed.

13. The self-sealing insulated panel of claim 5, wherein the foam board comprises expanded polystyrene, extruded polystyrene, or polyisocyanurate foam.

* * * * *